United States Patent [19]

Dossier

[11] Patent Number: 4,581,957

[45] Date of Patent: Apr. 15, 1986

[54] TIGHTENING TOOL FOR NUTS OR BOLTS

[75] Inventor: Michel Dossier, Paris, France

[73] Assignee: Facom, Morangis, France

[21] Appl. No.: 704,014

[22] Filed: Feb. 21, 1985

[30] Foreign Application Priority Data

Feb. 24, 1984 [FR] France ..... 84 02888

[51] Int. Cl.[4] ..... B25B 13/06

[52] U.S. Cl. ..... 81/121.1

[58] Field of Search ..... 81/121.1

[56] References Cited

U.S. PATENT DOCUMENTS

| | | | |
|---|---|---|---|
| 2,969,250 | 1/1961 | Kull . | |
| 3,125,910 | 3/1964 | Kavalar . | |
| 3,742,652 | 7/1973 | Enders | 51/128 |
| 3,753,320 | 8/1973 | Wurscher | 51/102 |
| 3,908,488 | 9/1975 | Andersen | 81/121.1 |
| 4,016,680 | 4/1977 | Moores et al. | 51/5 D |

*Primary Examiner*—Frederick R. Schmidt
*Assistant Examiner*—J. Zatarga
*Attorney, Agent, or Firm*—Wenderoth, Lind & Ponack

[57] ABSTRACT

This tool defines an inner opening (2) having a polygonal inscribed profile having six or twelve angles, said profile comprising grooves (3) at the place of said angles for the purpose of clearing the edges of the nut or bolt body to be driven, these grooves (3) being disposed between bearing surfaces (4) adapted to come into contact with the flat surfaces of said body so as to transmit the tightening or untightening torque. Said bearing surfaces (4) are convex in the direction toward the interior of the opening (2), the position of the contact edge of each bearing surface (4) being defined by a distance (x) to the mid-perpendicular (PM) of said flat surface, and the radius of curvature (R) at the contact of the profile of the bearing surface (4) being related to the value x by the relation:

$$\frac{N}{R + a/2} \tan 15°$$

in which:

a is the dimension between the flat surfaces of the inscribed profile of the tool, x is the distance between the contact edge of the mid-perpendicular (PM) of the flat surface, R is the radius of curvature at the contact of the profile of the bearing surface.

4 Claims, 4 Drawing Figures

TIGHTENING TOOL FOR NUTS OR BOLTS

The present invention relates to tools for driving screw-threaded nuts or bolts such as sockets, tube-spanners, eye-spanners and the like.

Many suggestions have been made in the past for improving tools of this type. They have all met with the difficulty which consists in taking into account for a given nominal dimension of an object to be tightened, such as a bolt or a nut, for example, of the large tolerances with which these objects may be manufactured in accordance with standards established in most industrial countries. Indeed, a tool which is poorly adapted to tighten nuts in the whole of the range of tolerances of the nominal dimension inevitably results in an impairment of a large number thereof, above all if the nut must be tightened and untightened frequently. Moreover, a poorly adapted tool does not transmit well the tightening torque on the nut.

In the U.S. Pat. Nos. 3,276,430 and 3,495,485 and the patent FR-A-1 489 313, there is disclosed a a driving tool for screw-threaded nuts or bolts, this tool having an inner opening which has a polygonal inscribed profile with 6 or 12 angles, this profile comprising grooves at the places of these angles for the purpose of clearing the edges of the bodies of the nut or bolt to be driven, these grooves being located between bearing surfaces adapted to come into contact with the flat surfaces of said body for transmitting the tightening or untightening torque.

In this prior tool, the bearing surfaces are planar and make an angle of 108° with the diametrical plane passing through the edge projecting in the opening according to which two adjacent bearing surfaces intersect.

Consequently, for an object to be tightened having a dimension slightly less than the opening of the tool, when the torque is applied, the concerned bearing surfaces have a tendency to be applied flat against the flat surfaces of the object whence an improved transmission of the torque is achieved and a marking of the object to be tightened or untightened is avoided.

However, this situation can only occur in respect of a single dimension of the object to be tightened, i.e. the nominal dimension of the latter as a function of which the dimension of the opening of the tool is chosen.

Consequently, if the nut or bolt object deviates from the nominal dimension to an extent allowed by the standard tolerances, the tool inevitably bears against the respective edges defining the bearing surfaces on each side. Such objects therefore cannot be subjected to a tightening or untightening torque with the maximum of efficiency, nor can they avoid marks after a certain number of turning operations.

An object of the invention is to provide a tool of the type defined hereinbefore which avoids the drawbacks of the prior tool and permits a suitable adaptation on the nut or bolt objects whose dimensions correspond to the whole range of tolerances allowed by the standards.

The invention therefore provides such a tool wherein said bearing surfaces are convex toward the interior of said opening, the position of the contact edge of each bearing surface being defined by a distance x from the mid-perpendicular plane of said surface, and the radius of curvature R at the contact of the profile of the bearing surface being related to the value x by the expression $$\frac{x}{R + a/2} < \tan 15°$$

in which:

a is the dimension between the flat surfaces of the inscribed profile of the tool, x is the distance from the contact edge to the mid-perpendicular plane of the flat surface, R is the radius of curvature at the contact of the profile of the bearing surface.

As a result of these characteristics:

the transmission of the torque of the tool on the nut or bolt object can be rendered optimum for a given overall size of the tool and, in a reciprocal manner, the overall size or the outside diameter of the tool can be reduced for a given torque to be transmitted;

the curvature of the bearing surfaces is so chosen that these surfaces bear, when the torque is applied, always on the flat surface and never on the edges of the nut or bolt objects, throughout the range of dimensions between the flat surfaces allowed by the standards for a given nominal dimension;

it is possible to determine, by choosing for the terms x and R suitable values, a Hertz pressure which is as favourable as possible, bearing in mind the materials of the tool, on one hand, and of the nut or bolt object on the other; this possibility of choice permits a deterioration of the contacting surfaces to be avoided.

According to another feature of the invention, the profile of the bearing surfaces is an arc of a circle.

This particular shape facilitates the manufacture of the tool, in particular by a cold heading operation.

It should be mentioned in this respect that it is known from U.S. Pat. No. 3,125,910 to employ bearing surfaces having a circular profile in a tool of the type of the invention. However, in this case, the axis of the centres of this profile is located on a dimetrical plane which is inclined at 15° to the mid-perpendicular plane of a flat surface of the inscribed polygon of the tool. This arrangement results in a pronounced curvature (small radius of curvature) so that the pressure of the bearing surfaces on the nut or bolt objects is comparatively distinctly less for a given applied torque. There is therefore a danger of this tool deteriorating the nut or bolt objects to an unacceptable extent.

A better understanding of the invention will be had from the following description which is given solely by way of example with reference to the accompanying drawings in which:

FIG. 1 shows a portion 1 of a nut or bolt tool which has a central opening 2 with a centre O and an inscribed polygon PI which is hexagonal. It therefore concerns a tool termed a "six points" tool.

Figure 1:
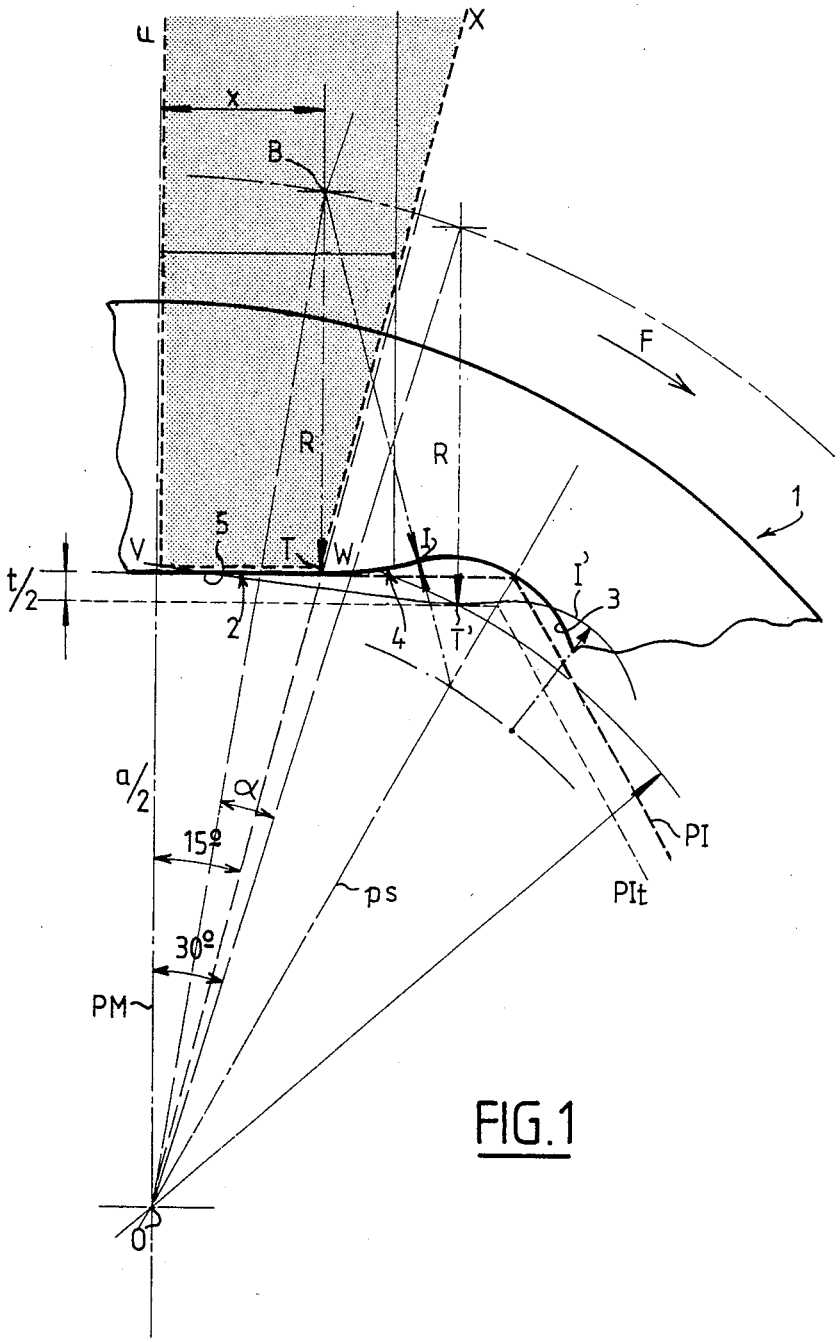
FIG. 1 is a diagram illustrating the basic principle of the invention applied to a nut or bolt whose inscribed polygon is a hexagon.

Considering that the portion 1 of the tool which corresponds to one of the angles of the inscribed hexagon PI, it can be seen that the opening 2 is defined by a groove 3 which is, in the illustrated embodiment, of circular cylindrical shape and symmetrical relative to the plane ps passing through the axis of the tool (point O) and the considered corner or angle of the inscribed polygon PI. This groove 3, which may have a shape other than that shown provided it constitutes a sufficiently deep cavity, is provided for always clearing the edge of the nut or bolt object to be tightened.

The cylindrical surface of the groove 3 is connected to a bearing surface 4 whose curvature is defined by a curve TI according to the characteristics of the invention. This bearing surface 4 is itself connected to a planar surface 5 which coincides with the corresponding side of the inscribed polygon PI.

As the nut, bolt or screw objects etc. are manufactured with a nominal dimension a, provided with a standardized range of tolerances, the dimension between the flat surfaces of such an object (diametrical distance between two opposed lateral surfaces) may vary between this dimension a and a value a–t, in which t is the maximum allowed tolerance. In FIG. 1, the hexagon corresponding to the dimension between the flats of the lowest value of the range of tolerances has been designated by $PI_t$.

Assuming first of all that the tool is placed on a nut or bolt object having a flat surface dimension a and then in keeping the same axis of rotation of an object of the dimension between surfaces a–t, the torque exerted on the object will place the bearing surface 4 (and the adjacent surface portions) in the position indicated by a thick line in the first case, and in the position indicated by a thin line, in the second case, the modifications in the position of the tool occurring in the direction of the arrow F. It can be seen that in order to take up in this case the clearance created by the difference of dimension between the flat surfaces, the tool has turned through an angle $\alpha$ and that, moreover, the bearing surface 4 comes into contact with the flat surface of the nut or bolt object, not at the point T, but at the point T', which is closer to the edge of the nut or bolt object. However, in both cases, the edge remains clear of the cylindrical surface of the groove 3.

According to the invention, the profile of the curve TI is characterized by two parameters which are respectively the radius of curvature R at the point of contact with the inscribed polygon and the distance x (offset) of the centre of curvature B at this point to the mid-perpendicular plane PM of the flat surface of the inscribed hexagon, PI, it being understood that:

$$\frac{x}{R + a/2} < \tan 15^\circ$$

Therefore, the centre of curvature B at this point of the curve TI is a point located in a zone UVWX, the position of this point being chosen as a function of several criteria including in particular the elastic resistance to compression of the materials employed.

Note that the profile is preferably an arc of a circle as is the case of the embodiment shown in FIG. 1.

It is clear from this Figure that the tool adapts itself in the best way to the nut or bolt object irrespective of its dimension between the flat surfaces a, provided it is located within the allowed range of tolerances.

The following considerations may aid the understanding of the invention.

As the torque C to be transmitted is given at the start, the force N with which a bearing surface 4 is applied on a flat surface of a nut or bolt object, is given by the equation (the friction being nil on greasy surfaces)

$$N = \frac{C}{6x}$$

in which the offset x is the leverage of this force with respect to the centre O.

As the essential object of the invention is to reduce the forces withstood by the tool, so as to increase the strength or to enable it to exert tightening or untightening torques which are higher for given dimensions, the force N just defined must be reduced and consequently the leverage x must be increased. Indeed, for a given torque, the outside dimension of the tool may thus be reduced so that it is better adapted to tighten or untighten nut or bolt objects which are hard of access.

Therefore, a maximum value must be chosen for the distance x in the most unfavourable case which is that shown in FIG. 1 in thick lines (the largest dimension between the flat surfaces a, it being understood that the range of tolerances of the dimensions of the tool itself are here neglected. However, increasing the leverage x has for corollary to reduce the radius of curvature R and consequently to increase the pressure exerted on the material of the nut or bolt object in the zone of contact with the tool, the area of this zone of course increasing with decrease in the radius of curvature R. Further, the choice of the length of the leverage x is also limited by the other extreme case which may occur, namely when the dimension between the flat surfaces is equal to a−t. Indeed, in this case, the bearing surface must remain in contact with the flat surface of the nut or bolt object at a point which is at a certain distance from the edge of the object (taking into account a safety margin).

The foregoing considerations have led to a compromise in the choice of the values of the distance x and of the radius of curvature R defined hereinbefore.

The following table gives a few practical examples for socket spanners incorporating the invention.

TABLE

| Dimension between flat surfaces a = 100 | | |
|---|---|---|
| Tolerance t (in %) | Radius R (% of a) | Offset x (% of a) |
| 5 | 35 | 16 |
| 4 | 43 | 18 |
| 3 | 50 | 20 |
| 2 | 70 | 22 |

It is clear that the invention is applicable to all tightening or untightening tools for nut or bolt objects such as socket-spanners, tube-spanners, pipe-spanners, polygonal eye-spanners, etc., this list being not exhaustive.

Figure 2:
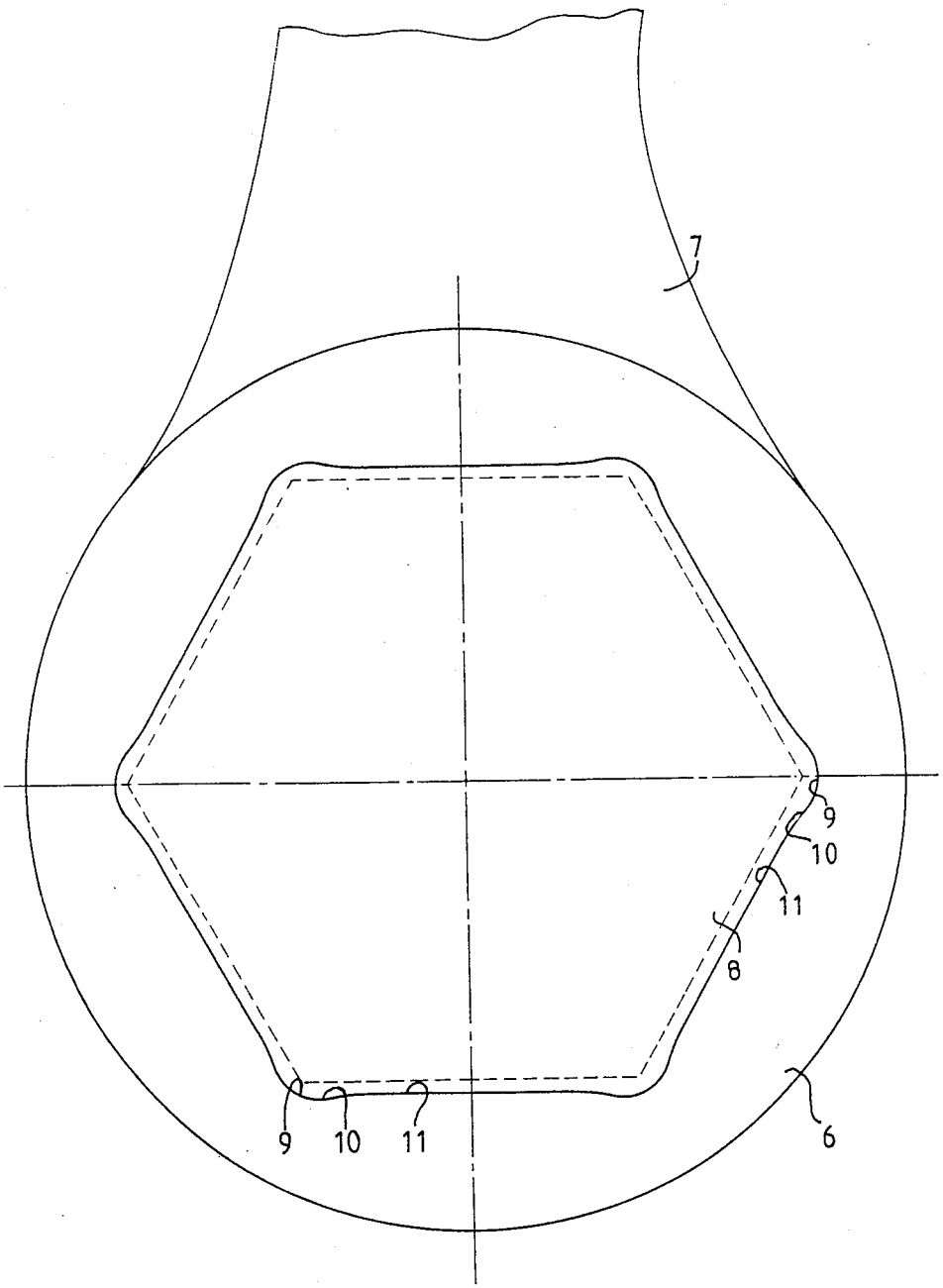
FIG. 2 is a diagrammatic view of a bolt or nut tool according to the diagram shown in FIG. 3.

FIG. 2 shows an example of the application of the invention to an eye-spanner 6 comprising a handle 7 and an opening 8 defined by grooves 9, the bearing surfaces 10 according to the invention and planar surfaces 11.

Figure 3:
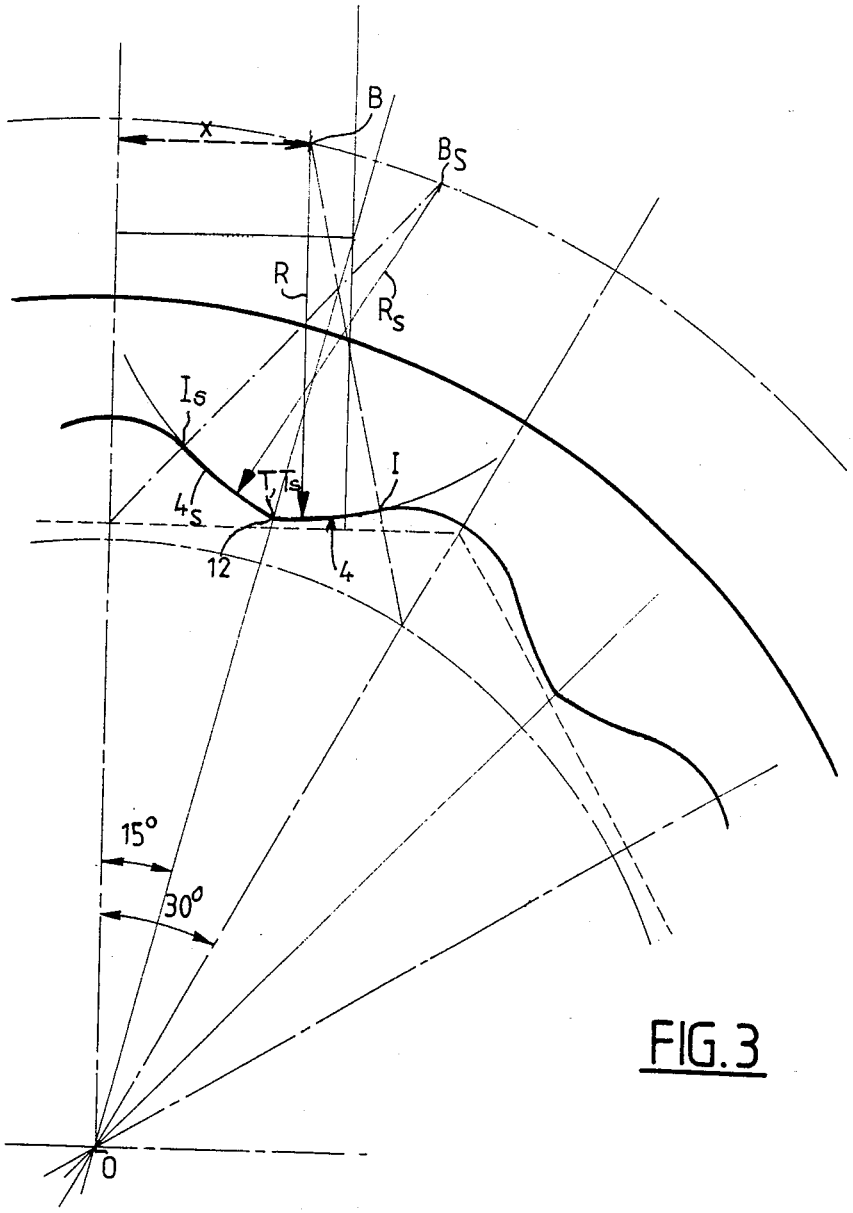
FIG. 3 is a diagram illustrating the application of the invention to a nut or bolt whose inscribed polygon is a dodecagonal.

FIG. 3 shows the diagram corresponding to a tool whose inscribed polygon has twelve angles. Each bearing surface 4 is connected by an edge 12 to a bearing surface 4s which is symmetrical thereto and is connected to the groove of the following angle of the dodecagon. The centres of curvature B and Bs of each of the curves TI and $T_sI_s$ are then located on each side and at equal distances from a straight line which is offset by 15° from the diameters passing through the adjacent angles of the dodecagon.

Figure 4:
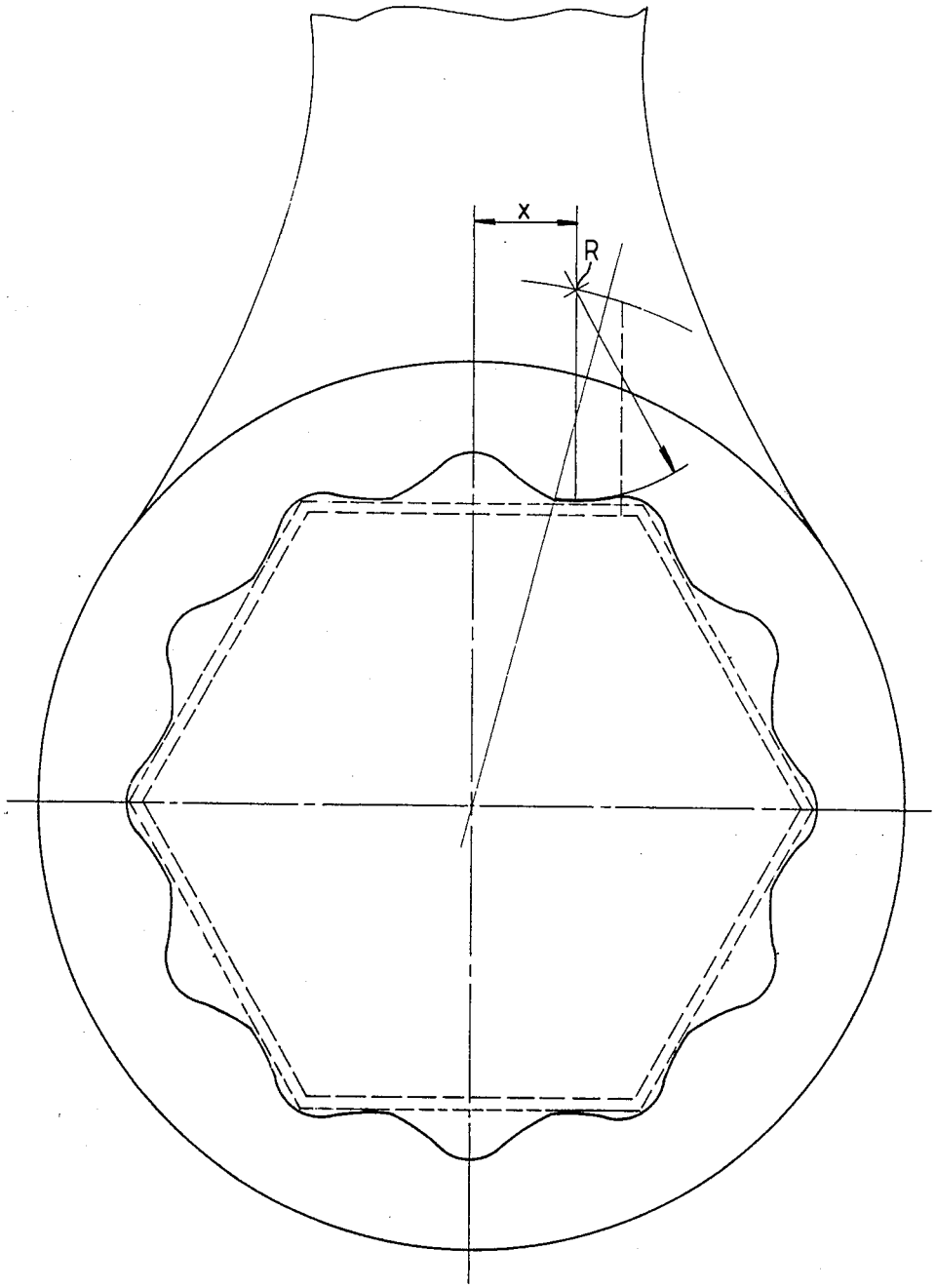
FIG. 4 is a view of a tool according to the invention which conforms to the diagram shown in FIG. 3.

An eye-spanner is shown in FIG. 4 in which the diagram of FIG. 3 is employed.

What is claimed is:

1. A tool for driving screw-threaded nut or bolt objects, said tool defining an inner opening having an inscribed polygonal profile having at least six angles, said profile comprising grooves at the place of said angles for the purpose of clearing edges of the nut or bolt body to be driven, two bearing surfaces disposed on each side of each groove, said bearing surfaces being provided for coming into contact with flat surfaces of said body so as to transmit a tightening or untightening torque, said bearing surfaces being convex in a direction toward the interior of said opening, the position of the contact edge of each bearing surface being defined by a distance x to the mid-perpendicular of said flat surface, and the radius of curvature R of contact of the profile of the bearing surface being related to the value x by the relation:

$$\frac{x}{R + a/2} < \tan 15^\circ$$

in which:

a is the dimension between the flat surfaces of the inscribed profile of the tool, x is the distance between the contact edge and the mid-perpendicular (PM) of the flat surface, R is the radius of curvature, at the contact, of the profle of the bearing surface.

2. A tool according to claim 1, wherein said bearing surface has a profile in the shape of an arc of a circle.

3. A tool according to claim 1, wherein, in the case where said profile has six angles, said bearing surface is connected, on the side thereof opposed to said groove to a planar surface coinciding with the flat surface of the inscribed profile.

4. A tool according to claim 1, wherein, in the case where said profile has twelve angles, each bearing surface on the side of a groove is connected to a bearing surface on the side of the neighbouring groove.

* * * * *